US011022085B2

(12) United States Patent
Raasch et al.

(10) Patent No.: US 11,022,085 B2
(45) Date of Patent: Jun. 1, 2021

(54) ENGINE OPERATION DETECTION SYSTEM

(71) Applicant: Briggs & Stratton, LLC, Wauwatosa, WI (US)

(72) Inventors: Jason Raasch, Wauwatosa, WI (US); Robert Koenen, Pewaukee, WI (US); Christopher Meyers, Wauwatosa, WI (US); Timothy Ogden, Wauwatosa, WI (US); Kevin Bernier, Wauwatosa, WI (US)

(73) Assignee: Briggs & Stratton, LLC, Wauwatosa, WI (US)

( * ) Notice: Subject to any disclaimer, the term of this patent is extended or adjusted under 35 U.S.C. 154(b) by 0 days.

(21) Appl. No.: 16/626,310

(22) PCT Filed: Jun. 28, 2018

(86) PCT No.: PCT/US2018/040086
§ 371 (c)(1),
(2) Date: Dec. 23, 2019

(87) PCT Pub. No.: WO2019/006163
PCT Pub. Date: Jan. 3, 2019

(65) Prior Publication Data

US 2020/0158072 A1 May 21, 2020

Related U.S. Application Data

(60) Provisional application No. 62/526,824, filed on Jun. 29, 2017.

(51) Int. Cl.

| | |
|---|---|
| ***F02P 7/077*** | (2006.01) |
| ***F02B 77/08*** | (2006.01) |
| ***F02P 17/12*** | (2006.01) |
| ***G07C 5/08*** | (2006.01) |

(52) U.S. Cl.
CPC ..... *F02P 7/077* (2013.01); *F02B 77/08* (2013.01); *F02P 17/12* (2013.01); *G07C 5/085* (2013.01)

(58) Field of Classification Search
CPC ..... F02P 7/077; F02P 7/0775; F02P 17/12; F02B 77/08; G07C 5/085; G07C 5/0841; G07C 7/00; F02D 41/1497; F02D 2200/101
USPC ..... 123/612–617
See application file for complete search history.

(56) References Cited

U.S. PATENT DOCUMENTS

| | | | |
|---|---|---|---|
| 4,255,789 | A | 3/1981 | Hartford et al. |
| 5,111,790 | A | 5/1992 | Grandy |
| 5,644,491 | A | 7/1997 | Fiske et al. |
| 2011/0208405 | A1 | 8/2011 | Tripathi et al. |

(Continued)

OTHER PUBLICATIONS

International Search Report and Written Opinion, PCT/US2018/040086, Briggs & Stratton Corporation, 9 pages (dated Sep. 20, 2018).

*Primary Examiner* — Hai H Huynh
(74) *Attorney, Agent, or Firm* — Foley & Lardner LLP

(57) ABSTRACT

An engine operation detection system includes an engine including a spark plug and a spark plug wire, and an engine run sensor including a signal wire including an antenna, the antenna configured to receive a spark plug signal from the spark plug wire, a data acquisition output wire outputting an engine on/off condition signal, a power supply providing power to the engine run sensing circuit, and an engine run sensing circuit configured to transform the spark plug signal into the engine on/off condition signal output via the data acquisition output wire.

20 Claims, 8 Drawing Sheets

(56) References Cited

U.S. PATENT DOCUMENTS

| | | | |
|---|---|---|---|
| 2015/0109142 | A1 | 4/2015 | Mejegard et al. |
| 2015/0123815 | A1 | 5/2015 | Mejegard et al. |
| 2017/0349058 | A1 | 12/2017 | Bernier et al. |

ENGINE OPERATION DETECTION SYSTEM

CROSS-REFERENCE TO RELATED PATENT APPLICATIONS

This application is a National Stage Application of PCT/US2018/040086, filed Jun. 28, 2018, which claims the benefit of and priority to U.S. Provisional Application No. 62/526,824, filed Jun. 29, 2017, both of which are incorporated herein by reference in their entireties.

BACKGROUND

The present invention generally relates to internal combustion engines and sensors used to detect operation of such engines. More specifically, the present invention relates to an engine operation detection system for an engine.

For engines including an electronic fuel injection (EFI) system, there is a readily available signal that can be used to determine an engine operational state. For carbureted engines, this signal may not be readily available. To determine an engine operational state with a carbureted engine, the same data gathering systems that can be used to obtain the readily available signal from an EFI system cannot be used. Additionally, for engines with an EFI system that are from a third-party engine manufacturer, the engine run signal may also not be readily available. Accordingly, an engine operation detection system that can be used on all types of engines is desired.

SUMMARY

One embodiment relates to an engine operation detection system. The engine operation detection system includes an engine including a spark plug and a spark plug wire, and an engine run sensor including a signal wire including an antenna, the antenna configured to receive a spark plug signal from the spark plug wire, a data acquisition output wire outputting an engine on/off condition signal, a power supply providing power to the engine run sensing circuit, and an engine run sensing circuit configured to transform the spark plug signal into the engine on/off condition signal output via the data acquisition output wire.

Another embodiment relates to an engine run sensor. The engine run sensor includes a signal wire including an antenna, the antenna configured to receive a spark plug signal from a spark plug wire on an engine, a data acquisition output wire outputting an engine on/off condition signal, a power supply providing power to the engine run sensing circuit, and an engine run sensing circuit configured to transform the spark plug signal into the engine on/off condition signal output via the data acquisition output wire.

Alternative exemplary embodiments relate to other features and combinations of features as may be generally recited in the claims.

BRIEF DESCRIPTION OF THE FIGURES

The disclosure will become more fully understood from the following detailed description, taken in conjunction with the accompanying figures, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Referring to the figures generally, an engine operation detection system for use with outdoor power equipment is described. The engine operation detection system detects a spark plug pulse signal from an engine used with outdoor power equipment and transforms the spark signal into an engine operation indication using either an engine-on condition signal or an engine-off condition signal. The engine operation indication is transmitted to an engine monitoring system (e.g., for transmission to a fleet management system) for display to an operator, for calculation of productivity statistics, engine efficiency values, operator efficiency values, production of maintenance schedules, etc. Outdoor power equipment includes lawn mowers, riding tractors, snow throwers, fertilizer spreaders, salt spreaders, chemical spreaders, pressure washers, portable air compressors, tillers, log splitters, zero-turn radius mowers, walk-behind mowers, wide area walk-behind mowers, riding mowers, stand-on mowers, pavement surface preparation devices, industrial vehicles such as forklifts, utility vehicles, commercial turf equipment such as blowers, vacuums, debris loaders, overseeders, power rakes, aerators, sod cutters, brush mowers, etc.

Figure 1:
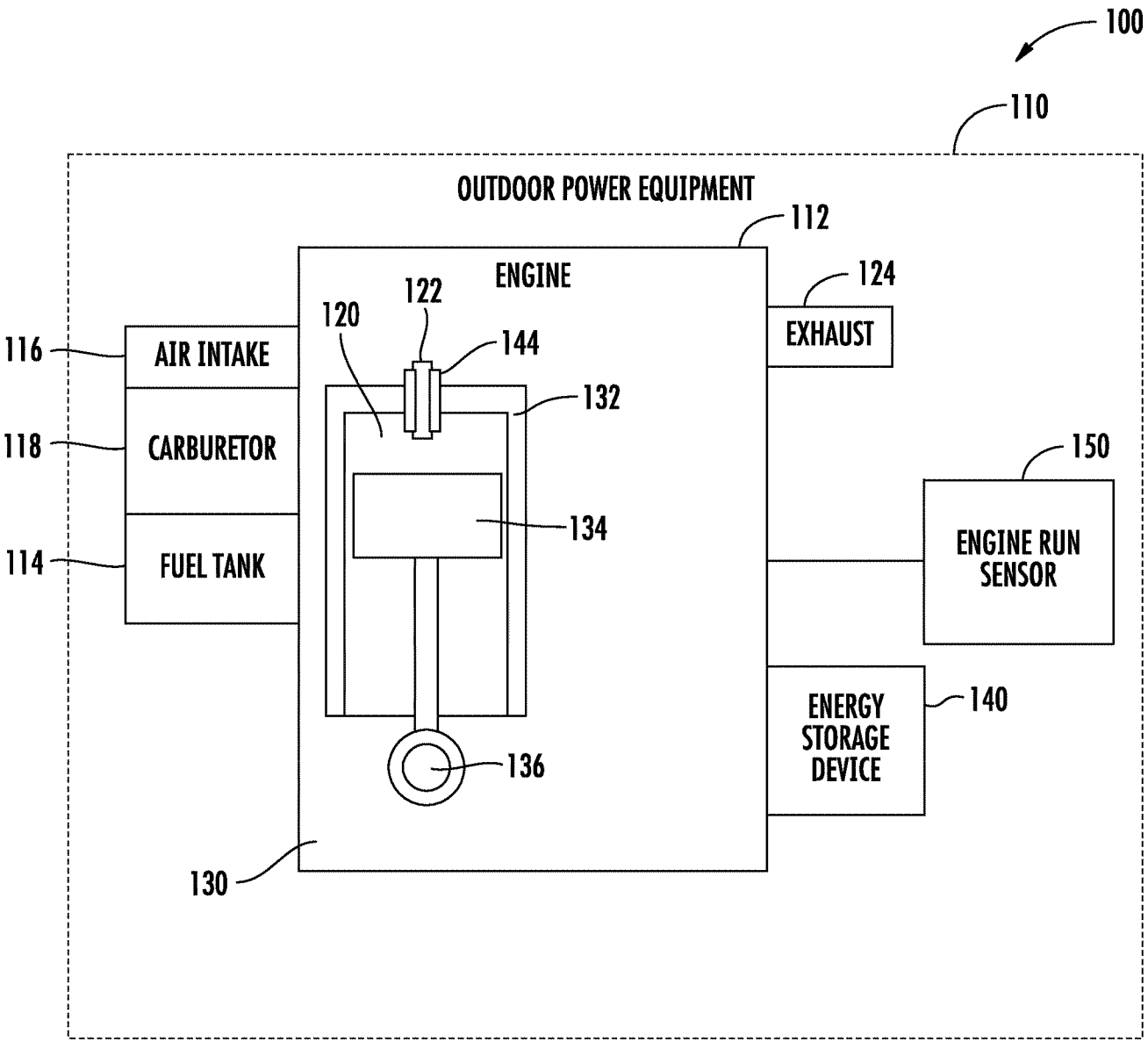
FIG. 1 is a schematic diagram of an internal combustion engine used on outdoor power equipment, according to an exemplary embodiment.

Referring to FIG. 1, an internal combustion engine used on outdoor power equipment is shown, according to an exemplary embodiment. The engine 112 includes an engine block 130 having a cylinder 132, a piston 134, and a crankshaft 136. The piston 134 reciprocates in the cylinder 132 to drive the crankshaft 136. The engine 112 further includes a fuel system having a fuel tank 114, an air intake 116, and a carburetor 118 or other air-fuel mixing device (e.g., electronic fuel injection, direct fuel injection, etc.). In the carburetor 118, fuel from the fuel tank 114 is mixed with filtered air from the air intake 116 to produce an air/fuel mixture for combustion in a combustion chamber 120 of the engine 112.

A spark plug 122 is positioned within the combustion chamber 120 and is configured to spark to ignite the air/fuel mixture in the combustion chamber 120. In some embodiments, an ignition armature (not shown) is mounted proximate to a flywheel (not shown) so that magnets within the flywheel pass the ignition armature at specifically timed intervals, generating a high-voltage charge once per rotation of the flywheel. The charge is directed to the spark plug 122 via a spark plug wire 142 (shown in FIG. 2) and used to ignite the air/fuel mixture. During operation of the engine 112, the piston 134 is driven by the timed ignitions of the air/fuel mixture in the combustion chamber 120, initiated by the spark plug 122. After ignition, the spent fuel and air is released from the combustion chamber 120 and out of the engine 112 via an exhaust outlet 124. The spark plug 122 includes an insulator 144 configured to prevent shorting between a center electrode and a ground electrode on the spark plug 122. The insulator 144 surrounds the body of the spark plug 122.

The outdoor power equipment 110 further includes an energy storage device 140 (e.g., electrical storage device) and an engine run sensor 150. The energy storage device 140 is configured to provide power to the engine run sensor 150 and other components of the engine 112 and/or outdoor power equipment 110. Accordingly, the energy storage device 140 is electrically coupled to the engine run sensor 150. The energy storage device 140 may include one or more batteries, capacitors, or other devices. In some embodiments, the energy storage device 140 includes a removable and rechargeable lithium-ion battery. The battery may be charged at a charging station or may include a charging port integrated with the battery (e.g., battery pack with charging port to receive a connection from a wire coupled to an outlet or the charging station). The battery, in other embodiments, may alternatively plug directly into a wall outlet, or the charging station may be wall mounted or plug directly into a wall outlet. In other embodiments, the energy storage device 140 includes a lead-acid battery. In other embodiments, other battery chemistries may be used.

Figure 2:
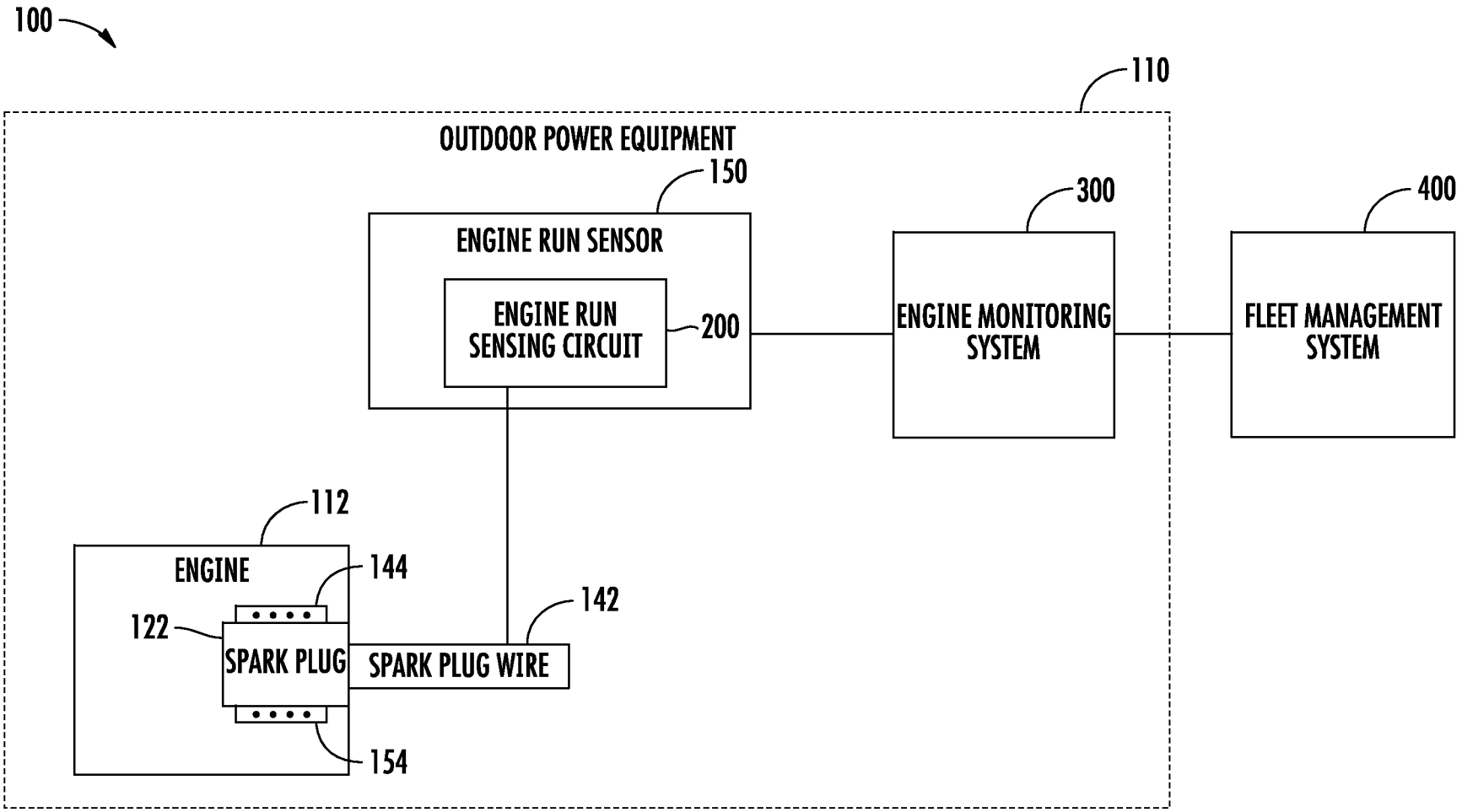
FIG. 2 is a schematic diagram of an engine operation detection system, according to an exemplary embodiment.

Referring to FIG. 2, an engine operation detection system 100 is shown, according to an exemplary embodiment. The outdoor power equipment 110 includes an engine run sensor 150 communicably coupled to an engine monitoring system 300. The engine monitoring system 300 is communicably coupled to a fleet management system 400 such that the engine monitoring system 300 can transmit engine on/off condition data to the fleet management system 400. The engine run sensor 150 is communicably and operatively coupled to the engine 112 and more specifically, to the spark plug wire 142. The engine run sensor 150 is configured to detect whether the engine 112 is running (e.g., detecting an engine-on condition or an engine-off condition). The engine run sensor 150 is configured to receive inputs associated with the spark plug signal carried by the spark plug wire 142 (e.g., signal carried from the armature to the spark plug 122) and generate a digital output indicating an engine on- or off-condition (e.g., engine on/off signal). The engine run sensor 150 uses the spark plug signal to transform the battery voltage into an engine on/off signal, as described further herein. The engine run sensor 150 transmits the engine on/off signal to the engine monitoring system 300. The engine monitoring system 300 may include or be a component of an outdoor power equipment fleet management system, such as the system disclosed in U.S. patent application Ser. No. 15/615,666 entitled "Fleet Management System for Outdoor Power Equipment," the content of which is incorporated herein in its entirety. The engine monitoring system 300 can use the engine on/off signal to calculate engine runtime to determine various operating conditions and efficiencies of the equipment 110 and operators of the equipment 110. As described further herein, the engine run sensor 150 may also generate a signal indicative of engine speed, which when received by the engine monitoring system 300, can be used to determine further operating conditions of the engine 112.

Figure 3A:
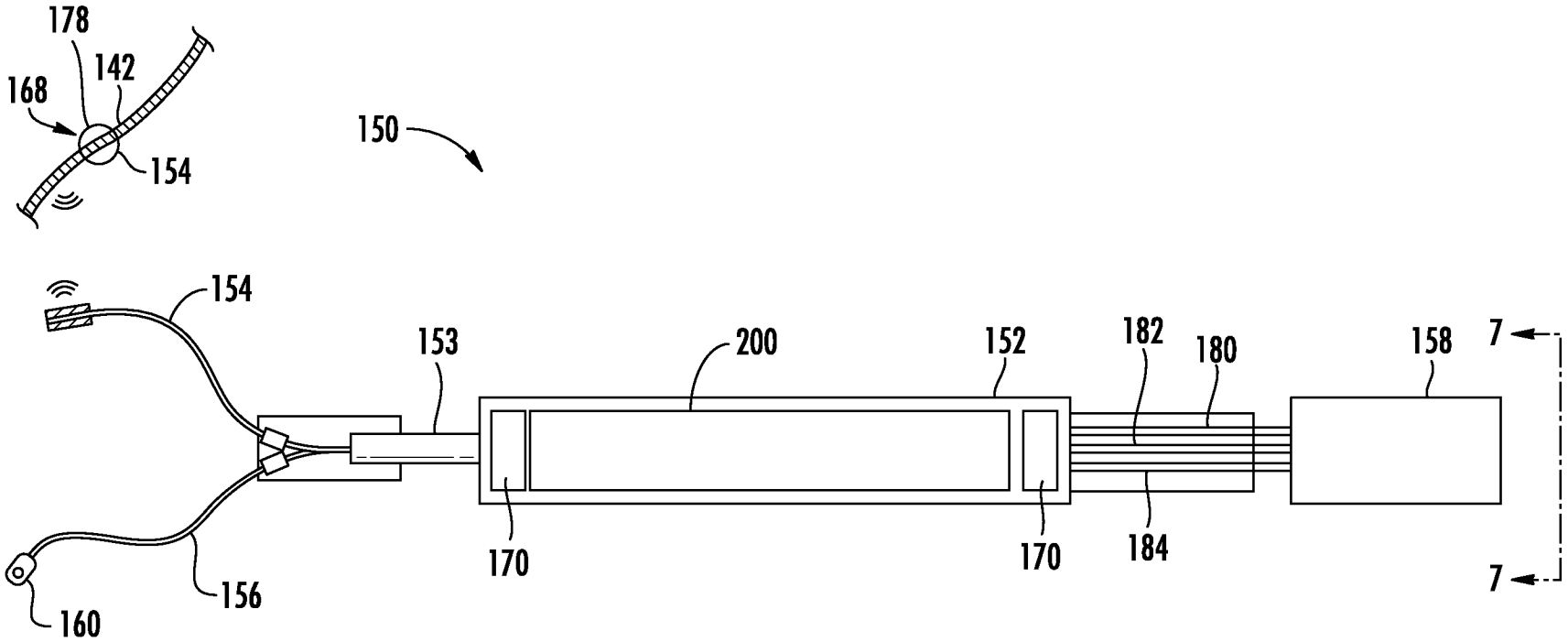
FIG. 3A is a schematic view of an engine run sensor, according to another exemplary embodiment.
Figure 3B:
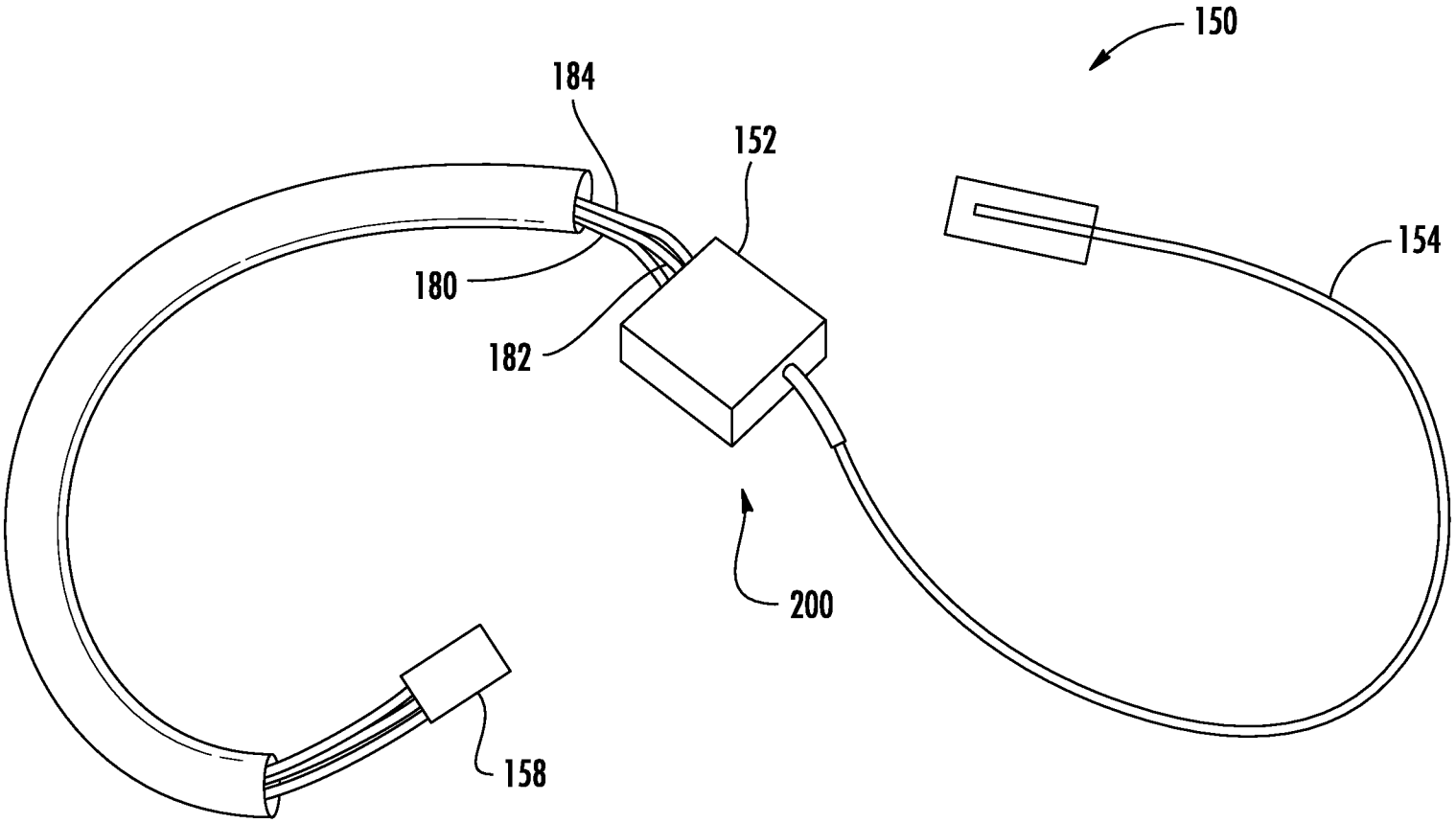
FIG. 3B is a perspective view of the engine run sensor of FIG. 3A.

Referring to FIGS. 3A-3B, the engine run sensor 150 includes an engine run sensing circuit 200 mounted on a printed circuit board and positioned within a housing 152 (e.g., flexible heat shrink circuit board jacket), a coaxial cable 153 positioned on one side of the housing 152 with a signal wire 154 and a grounding wire 156 extending therefrom, and a connector 158 on another side of the housing 152. The signal and grounding wires 154, 156 are located on an opposite side of the housing 152 from the connector 158 to accommodate connecting the engine run sensor 150 with one or more wiring harnesses in an in-line arrangement. In some embodiments, the grounding wire 156 is optional to the operation of the engine run sensor 150. In these embodiments, the grounding wire 156 may be cut off prior to installation of the sensor 150. Additionally, the engine run sensing circuit 200 is relatively long and thin, further allowing for the in-line arrangement shown in FIGS. 3A-3B. Accordingly, there is no need to mount the engine run sensor 150 directly to a mounting location on the engine 112 or outdoor power equipment 110. Rather, the engine run sensor 150 essentially becomes a part of the wiring harness. In some embodiments, the circuit 200 is incorporated on a double-sided printed circuit board to allow for ease of incorporation into a wire harness.

The coaxial cable 153 is electrically coupled to the engine run sensing circuit 200 and extends from the housing 152 for a distance until the signal wire 154 and the grounding wire 156 extend separately from the coaxial cable 153. The signal wire 154 and grounding wire 156 each include a splice (e.g., joint, connection) that acts as a connection (e.g., solder, crimp, ultrasonically weld, and covered by a waterproof material) for each wire 154, 156 to the coaxial cable 153. The splices are covered by a heat shrink jacket, which also overlaps the coaxial cable 153. The grounding wire 156 extends to a connector 160 that is secured to the engine block 130 or other ground via a fastener (e.g., bolt) for grounding purposes.

Referring to FIGS. 2 and 3A, the end of the signal wire 154 is positioned proximate the spark plug wire 142 such that communication between the spark plug wire 142 (or the signal from the spark plug) and the signal wire 154 is established. The signal wire 154 acts an antenna 168 that receives the spark plug signals from the spark plug wire 142, allowing for communication between the spark plug wire 142 and the signal wire 154 without direct connection. The signal wire 154 is looped at least once around the spark plug wire to form an antenna 168. Accordingly, the antenna 168 includes a ring 178 with at least one loop. The spark plug signal passing through the antenna 168 creates a change in the electromagnetic field, which the antenna 168 converts to an electrical signal (e.g., input signal). In some embodiments, the signal wire 154 is wrapped around the spark plug wire 142 multiple times (e.g., three or four coils). The signal wire 154 receives electromagnetic signals from the spark plug 122 or spark plug wire 142 without being directly coupled thereto. In some embodiments as shown in FIG. 2, the signal wire 154 is included in (e.g., molded into) the insulator 144 of the spark plug 122. In this way, an operator only needs to install the spark plug 122 into the engine without the additional step of positioning the signal wire 154 proximate the spark plug wire 142. In other embodiments, the signal wire 154 is included in an alligator clip. In some embodiments, the signal wire 154 is a pre-wound loop of wire that is molded into an annular connector that can be attached to (e.g., slid over, fitted onto) the spark plug 122.

The signal wire 154 carries an input signal indicative of the spark plug pulse signal to the engine run sensing circuit 200 for processing. The details of the components of circuit 200 are discussed below with regard to FIG. 4. The engine run sensing circuit 200 converts the received spark plug pulse signal into a digital output signal indicating high-voltage or low-voltage corresponding to either an engine-on condition or an engine-off condition. A voltage is detected from the spark plug signal and the signal is conditioned to be within a specific voltage range (e.g., 0 to 5 Volts (V)). Based on the received (and conditioned) voltage values, the digital output signal generates either a value of "1" which indicates an engine-on condition (e.g., high-voltage) or a value of "0" which indicates an engine-off condition (low-voltage). In other embodiments, these values may be switched (e.g., a value of "1" may indicate an engine-off condition, and so on). Smaller preset ranges within the voltage range (e.g., 0 to 5 V) are used by the circuit 200 to convert the specific voltage values into a binary/digital signal. For example, if the voltage detected from the spark plug signal is between 0 V and 0.8 V, the voltage would be considered a low-voltage and thus, would correspond to the engine-off condition. If the voltage is between 2 V and 5 V, the voltage would be considered a high-voltage and thus, would correspond to the engine-on condition. These example ranges are not to be limiting.

In some arrangements, the engine run sensing circuit 200 is configured as a digital-analog converter (e.g., frequency-to-analog converter), such that the circuit 200 converts the period/frequency of the received digital/binary spark plug signal (e.g., 1-bit digital signal) to an analog voltage proportional to engine speed. The output analog signal can include a voltage range proportional to a corresponding engine speed range. For example, the voltage may range between 0 and 5 V, where a voltage value of 2.4 V corresponds to an engine speed of 2400 revolutions per minute (RPM) and where a voltage value of 3.2 V corresponds to an engine speed of 3200 RPM. In this arrangement, the engine run sensing circuit 200 includes an integrator circuit. The integrator circuit collects pulses from ignition events in a capacitor, with a known leak from a resistor. The spark pulse frequency increases with engine speed. As such, with more spark pulses, the capacitor fills faster than the leak of electrons from the resistor. If the pulses are occurring faster than the resistor is leaking electrons, the voltage goes up and as such, the indicated proportional engine speed is higher. In other embodiments, a microcontroller or frequency-to-voltage integrated circuit is utilized to convert the pulse timing into a variable analog voltage.

Figure 7:
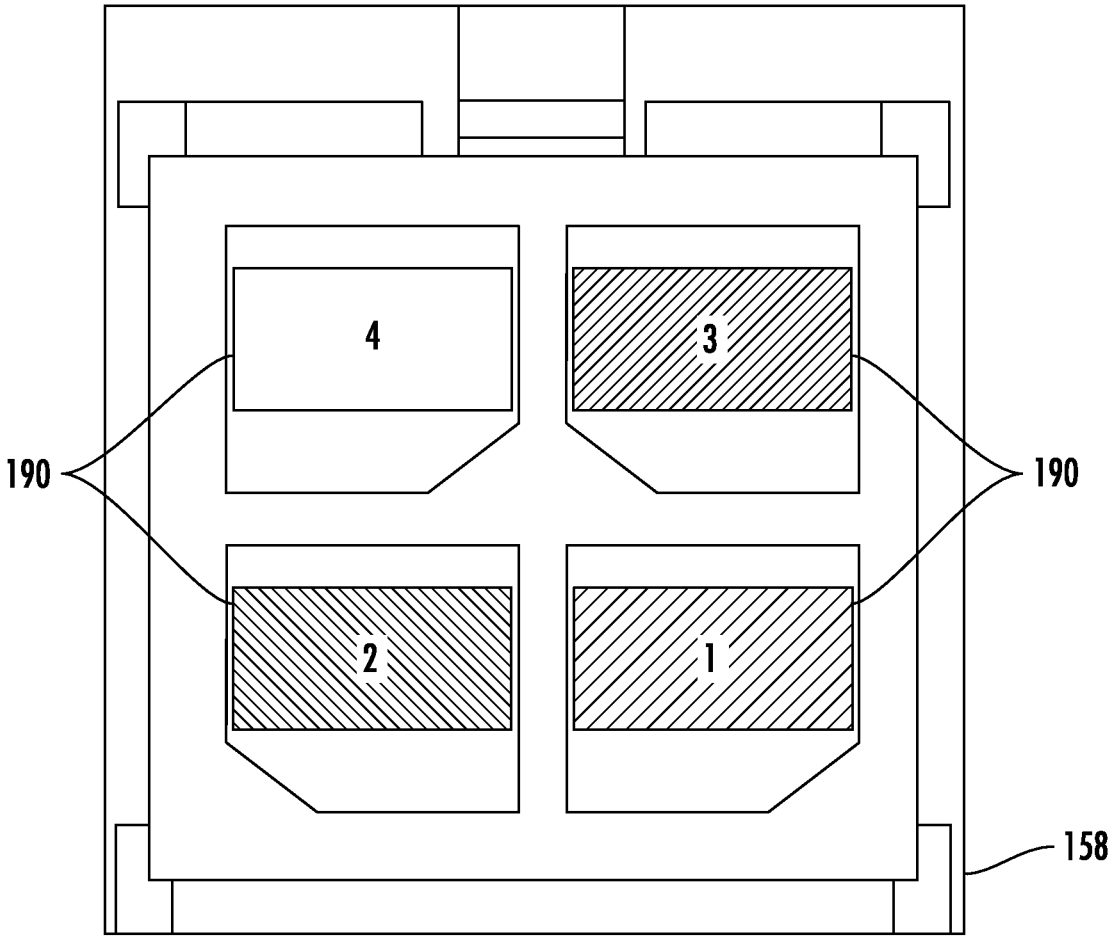
FIG. 7 is a section view along section line 7-7 of a connector of the engine run sensor of FIGS. 3A-3B.

Referring still to FIGS. 3A-3B, on the opposite side of the engine run sensing circuit 200 (e.g., opposite side of the housing 152) from the coaxial cable 153, output wires couple to and extend from the engine run sensing circuit 200 to a connector 158. Between the engine run sensing circuit 200 and the connector 158, the output wires are covered (e.g., wrapped) in a protective sheathing (e.g., flexible fire retardant heat shrink tubing). The output wires include a ground wire 180, a data acquisition wire 182, and a battery power wire 184 all electrically connected to the connector 158 and to the engine sensing circuit 200. Referring to FIG. 7, the end of the connector 158 is shown, according to an exemplary embodiment. The connector 158 is a four-pin male connector including multiple pins 190 each electrically connected to one of the ground wire 180, the data acquisition wire 182, and the battery power wire 184. The connector 158 couples to the engine monitoring system 300 to communicate the engine on/off condition signal from the engine run sensing circuit 200.

Two rubber grommets 170 may be positioned within the housing 152 on each side of the engine run sensing circuit 200 to secure the wires (e.g., coaxial cable 153, output wires 180, 182, 184) within the housing 152 such that movement of the wires is limited.

The engine on/off condition signal may be displayed on a visual indicator on either the engine 112 or the outdoor power equipment 100. The engine on/off condition signal may also be displayed by the engine monitoring system 300 for use in a fleet management system (e.g., on an enterprise computing system or user mobile device included with a fleet management system). The engine on/off signal may also be stored in a memory (e.g., database) included with a fleet management system.

Figure 4:
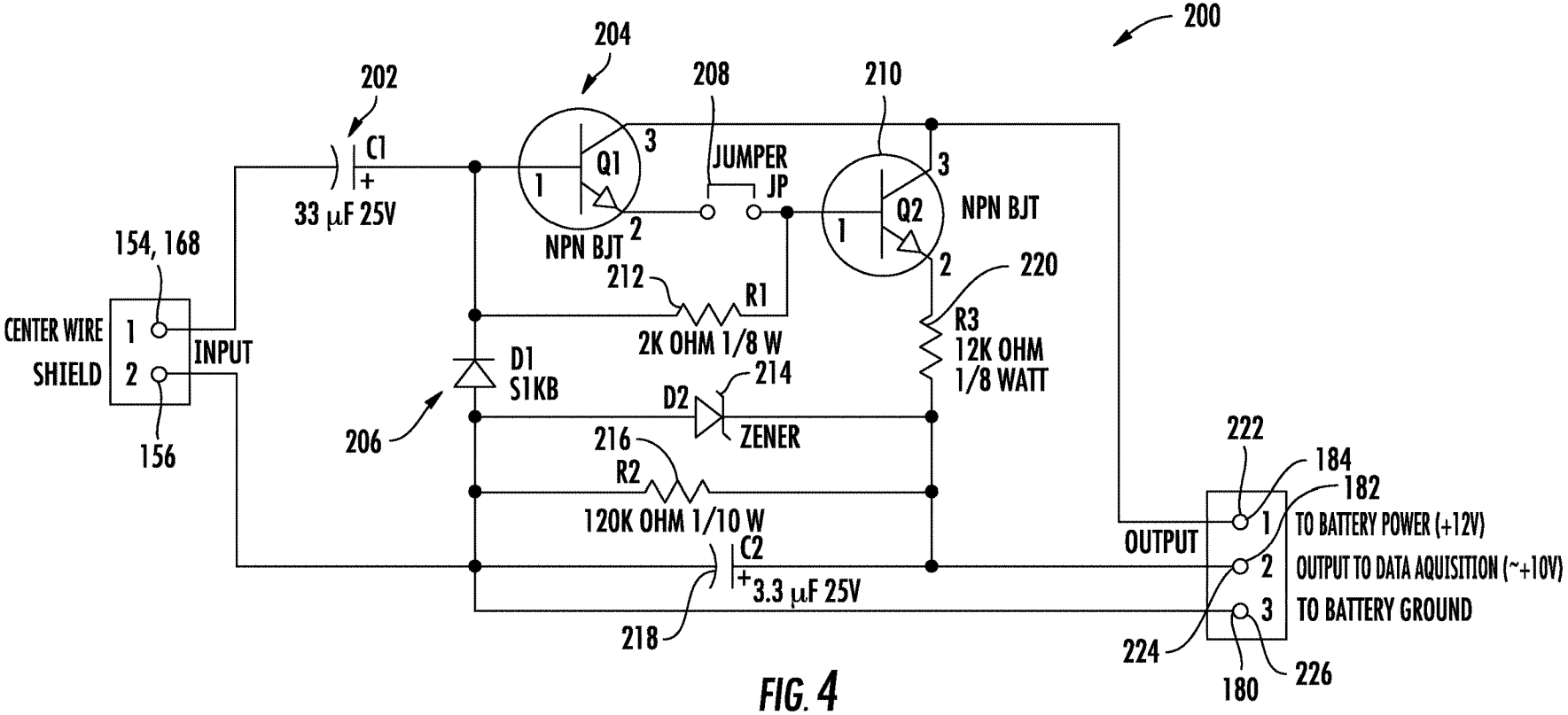
FIG. 4 is a circuit diagram for an engine run sensing circuit of the engine run sensor of FIGS. 3A-3B, according to an exemplary embodiment.

Referring to FIG. 4, a circuit diagram for the engine run sensing circuit 200 is shown, according to an exemplary embodiment. The signal wire 154 forming the antenna 168 is shown as coupled to the input of the circuit 200. The grounding wire 156 (e.g., shield) is also shown as coupled to the input of the circuit 200. The input of the circuit 200 couples by way of capacitor 202 to the base of transistor 204. The collector of transistor 204 is coupled to the collector of transistor 210 and to the power supply 222 (e.g., battery power wire 184). The emitter of transistor 204 is coupled by way of a jumper 208 and resistor 212 to the base of transistor 210. The transistor 204 acts to pull to low-voltage.

The collector of transistor 210 is coupled to the power supply 222 and the emitter of transistor 210 is coupled by way of resistor 220 to the output 224 (e.g., data acquisition wire 182). The transistor 210 acts to go to high-voltage. Resistor 220 acts to limit the current output in the case of the signal wire 154 touching ground. The input of the circuit 200 couples by way of capacitor 218, resistor 216, and Zener diode 214 to the output 224 and also couples to the battery ground 226 (e.g., battery ground wire 180).

The engine run sensing circuit 200 is configured to accommodate a variety of ignition systems and a range of spark signals (e.g., weak, strong). Accordingly, the circuit 200 includes transistors 204 and 210, which when coupled in series, act to amplify the input when there is a weak signal received from the signal wire 154. The circuit 200 includes a parallel resistor-capacitor (RC) circuit configured to smooth the pulse and a diode 206 and Zener diode 214 acting as a shunt to ground if the voltage has exceeded a threshold voltage. The diode 206 and Zener diode 214 also act as a full wave bridge rectifier to correct for the polarity of the signal.

Figure 5:
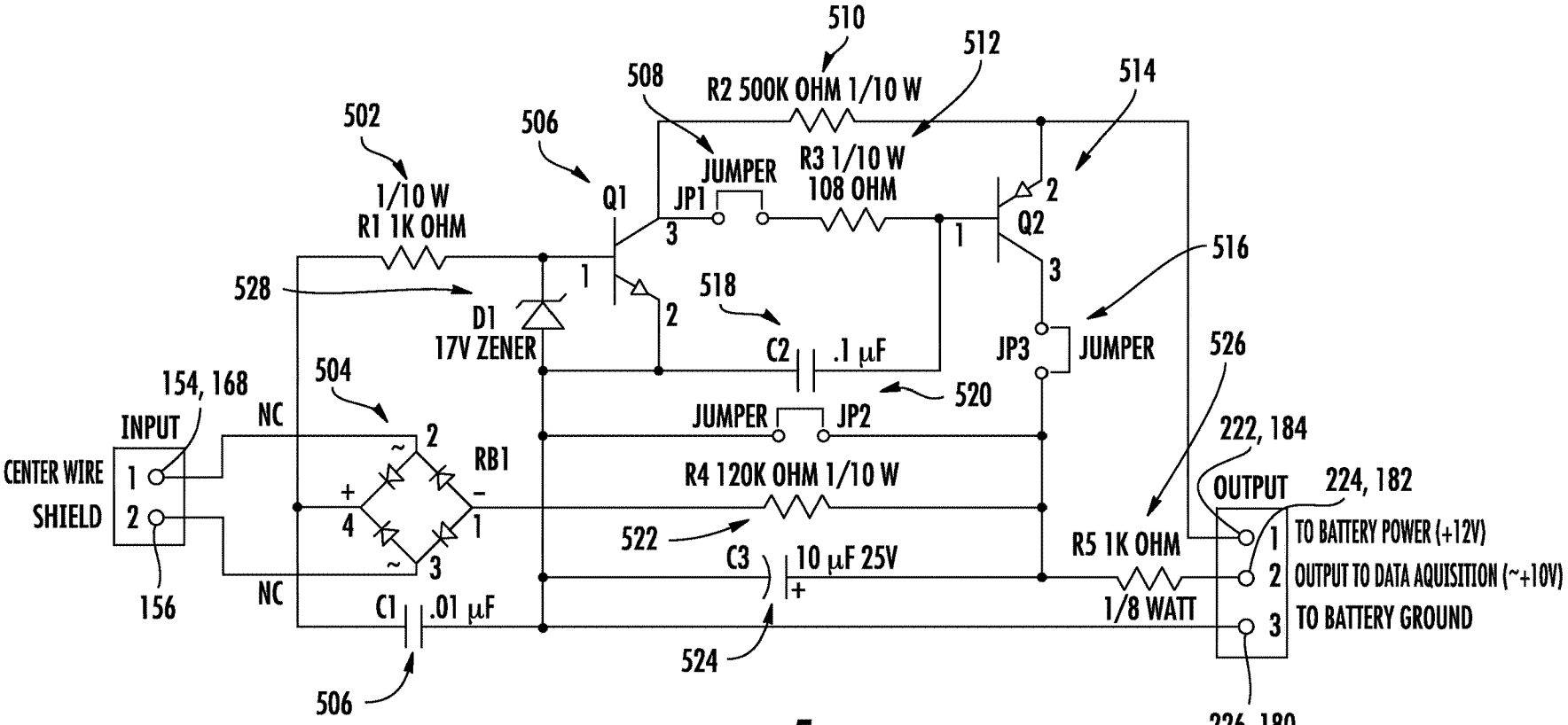
FIG. 5 is a circuit diagram for an engine run sensing circuit of the engine run sensor of FIGS. 3A-3B, according to another exemplary embodiment.

Referring to FIG. 5, a circuit diagram for the engine run sensing circuit is shown, according to another exemplary embodiment. The signal wire 154 forming the antenna 168 is shown as coupled to the input of the circuit 500. The grounding wire 156 (e.g., shield) is also shown as coupled to the input of the circuit 500. The input of the circuit 500 couples by way of resistor 502 to the base of transistor 506. The collector of transistor 506 is coupled to the base of transistor 514 by way of a jumper 508 and a resistor 512 and to the power supply 222 (e.g., battery power wire 184) via resistor 510. The emitter of transistor 506 is coupled by way of capacitor 518 to the base of transistor 514.

The collector of transistor 514 is coupled to the power supply 222 and the emitter of transistor 514 is coupled by way of jumper 516 and resistor 526 to the output 224 (e.g., data acquisition wire 182). Resistor 526 acts to limit the current output in the case of the signal wire 154 touching ground. The input of the circuit 500 couples by way of full wave bridge rectifier 504, capacitor 506, jumper 520, resistor 522, capacitor 524, and resistor 526 to the output 224 and also couples to the battery ground 226 (e.g., battery ground wire 180).

Figure 6:
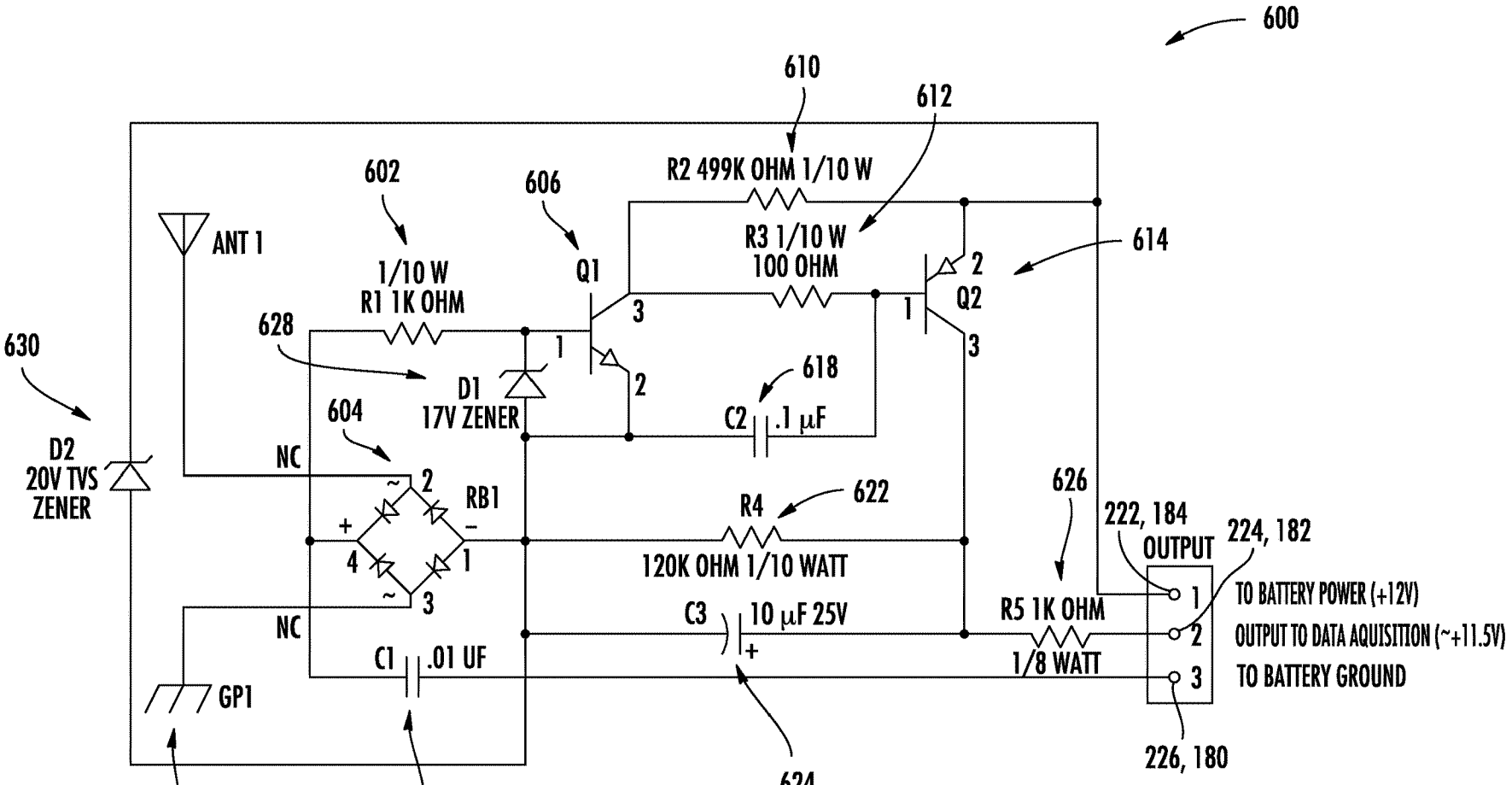
FIG. 6 is a circuit diagram for an engine run sensing circuit of the engine run sensor of FIGS. 3A-3B, according to another exemplary embodiment.

Referring to FIG. 6, a circuit diagram for the engine run sensing circuit is shown, according to another exemplary embodiment. The input of the circuit 600 couples by way of resistor 602 to the base of transistor 606. The collector of transistor 606 is coupled to the base of transistor 614 by way of a jumper 608 and a resistor 612 and to the power supply 622 (e.g., battery power wire 184) via resistor 610. The emitter of transistor 606 is coupled by way of capacitor 618 to the base of transistor 614.

The collector of transistor 614 is coupled to the power supply 222 and the emitter of transistor 614 is coupled by way of resistor 626 to the output 224 (e.g., data acquisition wire 182). Resistor 626 acts to limit the current output in the case of the signal wire 154 touching ground. The input of the circuit 600 couples by way of full wave bridge rectifier 604, capacitor 606, Zener diode 628, Zener diode 630, resistor 622, capacitor 624, and resistor 626 to the output 224 and also couples to the battery ground 226 (e.g., battery ground wire 180). Diode 630 is a transient-voltage-suppression (TVS) diode, which protects the circuit 600, engine run sensor 150, and system 100 from transient voltage spikes.

According to an exemplary embodiment, the circuits 200, 500, 600 shown in FIGS. 4-6 are contained on non-programmable circuitry, circuit boards, or a processing circuit that are integrated with a component of the engine, and may be fully powered by the energy storage device 140 or other on-board source. Accordingly, the circuits 200, 500, 600 may require no electrical interface or connection to components of the outdoor power equipment aside from those carried by or integrated with the engine. No additional wiring or hook ups are required. Accordingly, the assembly process for the associated outdoor power equipment may be improved.

Alternatively, in accordance with another exemplary embodiment, the circuits 200, 500, 600 shown in FIGS. 4-6 may be contained on non-programmable circuitry, circuit boards, or a processing circuit within the housing of the energy storage device and may be fully powered by the energy storage device (e.g., battery or other power source). As is known, energy storage devices generally have integrated circuitry contained therein that is configured to monitor operating variables of the energy storage device (current, voltage, etc.) related to its charge state. Thus, the addition of the circuits 200, 500, 600 of FIGS. 4-6 to the existing circuit board(s) or on an additional circuit board within the housing of the energy storage device is possible.

In contemplated embodiments, the engine run detection system 100 may receive additional or different inputs used to detect various equipment and engine characteristics, such as input from a sensor configured to indicate whether the outdoor power equipment 110 has moved recently, engine operational parameters, such as temperature inputs, pressure inputs, etc. In contemplated embodiments, the system 100 may also provide a signal output to the operator, such as a visible indicator on a display coupled to the engine, to a handle or chassis of outdoor power equipment, or an audible alert.

The engine run sensor 150 is easily connected in-line with existing wiring, thereby eliminating the need for adding additional wiring or significantly rerouting wiring for outdoor power equipment. The engine run sensor 150 is relatively small in size and light weight. This allows the engine run sensor 150 to be connected to existing wiring and not physically mounted to any other component of the outdoor power equipment. That is, once connected to the existing wiring, the engine run sensor 150 is free to remain otherwise unsupported (e.g. dangle with the existing wiring harnesses) by a mount, bracket, or other physical support structure on the outdoor power equipment.

The construction and arrangements of the engine operation system, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures may show or the description may provide a specific order of method steps, the order of the steps may differ from what is depicted. Also two or more steps may be performed concurrently or with partial concurrence. Such variation will depend on various factors, including software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. An engine operation detection system comprising:

an engine including a spark plug and a spark plug wire;

an engine run sensor comprising:

a signal wire including an antenna, the antenna configured to receive a spark plug signal from the spark plug wire;

a data acquisition output wire outputting an engine on/off condition signal;

a power supply providing power to an engine run sensing circuit;

wherein the engine run sensing circuit is configured to transform the spark plug signal into the engine on/off condition signal output via the data acquisition output wire.

2. The system of claim 1, wherein the antenna comprises a ring formed by the signal wire.

3. The system of claim 2, wherein the ring comprises at least one loop.

4. The system of claim 2, wherein the ring comprises a plurality of loops.

5. The system of claim 1, wherein the signal wire is molded into an insulator fitted onto the spark plug.

6. The system of claim 1, wherein the signal wire is a pre-wound loop positioned within an annular connector configured to fit over the spark plug.

7. The system of claim 1, wherein the engine run sensing circuit includes a connector configured to interface with a fleet management system, wherein the connector includes the data acquisition output wire.

8. The system of claim 7, wherein the engine run sensing circuit is positioned between the connector and the signal wire;

wherein the connector is positioned on one side of the engine run sensing circuit and the signal wire extends from an opposite side of the engine run sensing circuit from the connector;

wherein the connector, engine run sensing circuit, and signal wire are configured in an in-line arrangement.

9. The system of claim 1, wherein the engine run sensing circuit outputs a binary signal indicative of the engine on/off condition.

10. The system of claim 1, wherein the engine run sensing circuit comprises a digital to analog converter;

wherein the engine run sensing circuit outputs an analog signal corresponding to a range of voltages proportional to a range of engine speeds.

11. The system of claim 10, wherein the engine run sensing circuit includes an integrator circuit.

12. An engine run sensor comprising:

a signal wire including an antenna, the antenna configured to receive a spark plug signal from a spark plug wire on an engine;

a data acquisition output wire outputting an engine on/off condition signal; and a power supply providing power to an engine run sensing circuit;

wherein the engine run sensing circuit is configured to transform the spark plug signal into the engine on/off condition signal output via the data acquisition output wire.

13. The sensor of claim 12, wherein the antenna comprises a ring formed by the signal wire.

14. The sensor of claim 12, wherein the signal wire is molded into an insulator fitted onto the spark plug.

15. The sensor of claim 12, wherein the signal wire is a pre-wound loop positioned within an annular connector configured to fit over a spark plug of the engine.

16. The sensor of claim 12, wherein the engine run sensing circuit includes a connector configured to interface with a fleet management system, wherein the connector includes the data acquisition output wire.

17. The sensor of claim 16, wherein the engine run sensing circuit is positioned between the connector and the signal wire;

wherein the connector is positioned on one side of the engine run sensing circuit and the signal wire extends from an opposite side of the engine run sensing circuit from the connector;

wherein the connector, engine run sensing circuit, and signal wire are configured in an in-line arrangement.

18. The sensor of claim 12, wherein the engine run sensing circuit outputs a binary signal indicative of the engine on/off condition.

19. The sensor of claim 12, wherein the engine run sensing circuit comprises a digital to analog converter;

wherein the engine run sensing circuit outputs an analog signal corresponding to a range of voltages proportional to a range of engine speeds.

20. The sensor of claim 19, wherein the engine run sensing circuit includes an integrator circuit.

* * * * *